US011944144B2

(12) United States Patent
Hogberg

(10) Patent No.: US 11,944,144 B2
(45) Date of Patent: Apr. 2, 2024

(54) LOOP STRUCTURE WITH A POCKET SPACE FOR STORAGE

(71) Applicant: NIKE, Inc., Beaverton, OR (US)

(72) Inventor: Alison M. Hogberg, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 138 days.

(21) Appl. No.: 16/696,163

(22) Filed: Nov. 26, 2019

(65) Prior Publication Data

US 2020/0245704 A1 Aug. 6, 2020

Related U.S. Application Data

(60) Provisional application No. 62/799,472, filed on Jan. 31, 2019.

(51) Int. Cl.
*A41F 9/00* (2006.01)

(52) U.S. Cl.
CPC ..... *A41F 9/00* (2013.01)

(58) Field of Classification Search
CPC ... A41F 9/07; A41F 9/00; A41F 9/007; A44B 11/2596; A41D 2300/50; A41D 2300/30; F41H 1/02
USPC ..... 2/244, 102
See application file for complete search history.

(56) References Cited

U.S. PATENT DOCUMENTS 1,504,249 A * 8/1924 Klein ..... A41D 7/00 D2/737
1,645,502 A 10/1927 Adams
1,866,428 A 7/1932 Smith
2,022,621 A * 11/1935 Ide ..... A41D 7/00 2/70
3,271,783 A * 9/1966 Mallett ..... A41F 9/007 2/236
3,789,431 A 2/1974 Rand
4,788,723 A 12/1988 Doelfel
4,800,594 A 1/1989 Young
5,259,541 A 11/1993 Reese
5,797,145 A 8/1998 Levinson
D494,754 S 8/2004 Murphy
7,424,962 B2 9/2008 Mooney
D661,871 S 6/2012 Savage
(Continued)

FOREIGN PATENT DOCUMENTS

DE 29813789 U1 10/1998
DE 202012009900 U1 12/2012
(Continued)

OTHER PUBLICATIONS

"Pocket Belt Loop Clip Steel Clasp Silicone Case for Fitbit Alta Activity Tracker," boomdealer.com, Dec. 27, 2018.
(Continued)

*Primary Examiner* — Alissa J Tompkins
*Assistant Examiner* — Catherine M Ferreira
(74) *Attorney, Agent, or Firm* — Shook, Hardy & Bacon L.L.P.

(57) ABSTRACT

Aspects herein include a trim piece or waistband comprising a loop structure having a pocket space usable for storing one or more items. The loop structure has an inner layer material and an outer layer material that form a pocket opening on one side of the loop structure for insertion of items into the pocket space.

11 Claims, 9 Drawing Sheets

(56) References Cited

U.S. PATENT DOCUMENTS

| | | | | |
|---|---|---|---|---|
| 9,015,867 | B2 * | 4/2015 | Kenney | A41D 13/0017 2/229 |
| 9,162,124 | B1 | 10/2015 | VanNatten et al. | |
| 9,271,532 | B2 | 3/2016 | Cole | |
| 9,961,947 | B2 | 5/2018 | Cockram | |
| 10,010,158 | B2 | 7/2018 | Do | |
| 2006/0091174 | A1 * | 5/2006 | Mooney | A63B 57/207 224/675 |
| 2009/0300818 | A1 * | 12/2009 | Waite | A41D 1/14 2/76 |
| 2009/0320182 | A1 | 12/2009 | Schmalz et al. | |
| 2011/0192062 | A1 | 8/2011 | Washington | |
| 2012/0090076 | A1 * | 4/2012 | Kenney | A41D 15/02 2/211 |
| 2012/0096628 | A1 | 4/2012 | Grady | |
| 2012/0117705 | A1 * | 5/2012 | Hawkins | A41D 13/065 2/23 |
| 2016/0100642 | A1 | 4/2016 | Swan et al. | |
| 2016/0331053 | A1 | 11/2016 | Gordon et al. | |
| 2017/0295870 | A1 * | 10/2017 | Harris | A41C 3/12 |
| 2018/0035736 | A1 | 2/2018 | Le | |

FOREIGN PATENT DOCUMENTS

| | | | |
|---|---|---|---|
| JP | 48-085816 | U | 10/1973 |
| JP | 58-074822 | U | 5/1983 |
| JP | 61-198219 | U | 12/1986 |
| JP | 01-168525 | U | 11/1989 |
| JP | 3180738 | U | 1/2013 |
| JP | 2015-014067 | A | 1/2015 |

OTHER PUBLICATIONS

"Pocket Knife Sheath Basket Diagonal Belt Loop for Secure Fastening Sleeve," hilason.com, Dec. 17, 2018.

"Extra Wide Belt Loops," Eleven Workwear, elevenworkwear.com.au, Mar. 12, 2016.

International Preliminary Report on Patentability received for PCT Patent Application No. PCT/US2019/065640, dated Aug. 12, 2021, 11 pages.

International Search Report and Written Opinion received for PCT Patent Application No. PCT/US2019/065640, dated Mar. 11, 2020, 16 pages.

Office Action received for European Patent Application No. 19836281.6, dated Sep. 7, 2023, 4 pages.

* cited by examiner

LOOP STRUCTURE WITH A POCKET SPACE FOR STORAGE

CROSS-REFERENCE TO RELATED APPLICATIONS

This application, having U.S. Non Provisional patent application Ser. No. 16/696,163 and entitled "Lightweight, Permeable Garment Formed From Monofilament Yarns," claims priority to U.S. Provisional Patent Application No. 62/678,019, filed May 30, 2018, and entitled, "Lightweight, Permeable Garment Formed From Monofilament Yarns," the entirety of which is incorporated here by reference.

TECHNICAL FIELD

Aspects herein include a loop structure comprising a pocket opening and pocket space usable for stowing one or more items and capable of being integrated into an article of apparel.

BACKGROUND

Garments, such as pants or shorts, may lack usable pocket spaces for stowing items for use while conducting physical activity that do not interfere with a wearer's athletic performance.

DESCRIPTION OF THE DRAWINGS

Examples of aspects herein are described in detail below with reference to the attached drawing figures, wherein.

DETAILED DESCRIPTION

Figure 1A:
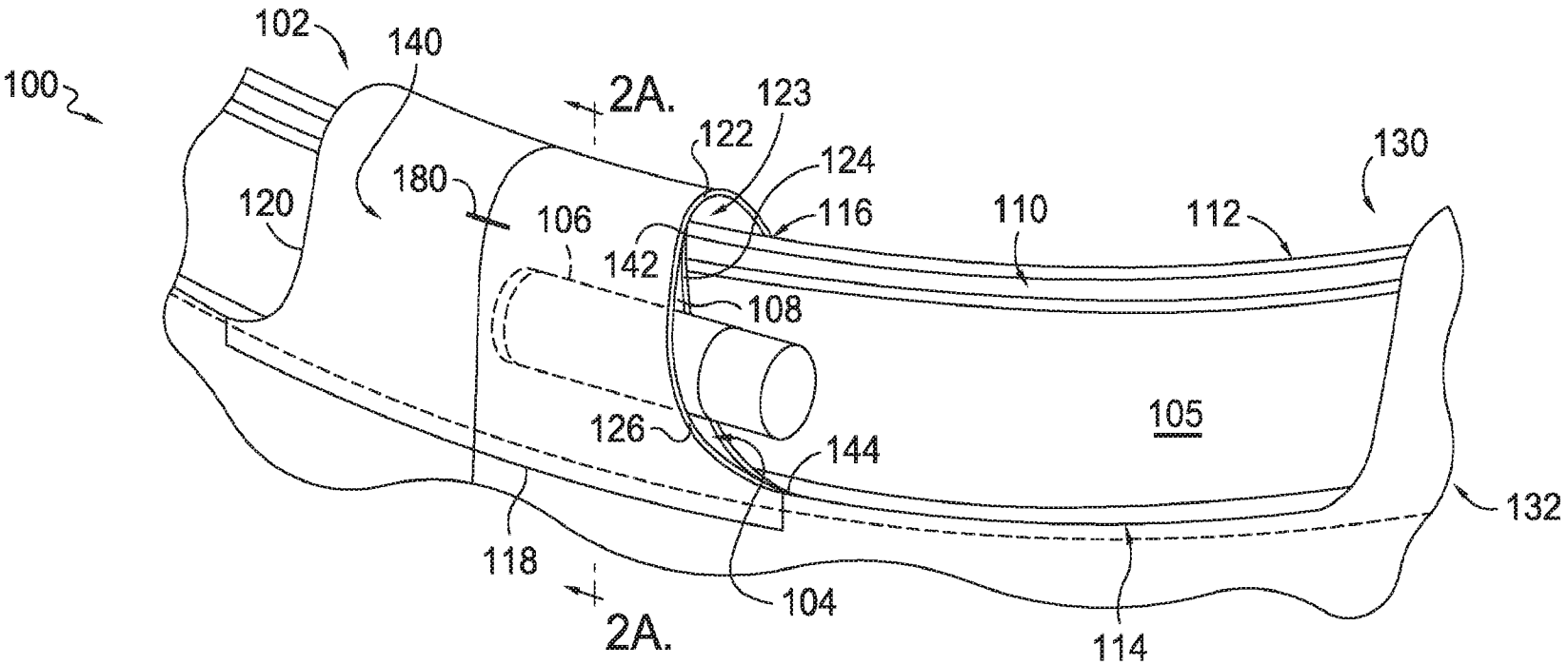
FIG. 1A illustrates a perspective view of a portion of a lower-body garment comprising a waistband and a loop structure having a pocket space in which an example item is shown being inserted into the pocket space by way of a pocket opening, in accordance with aspects herein.

The subject matter of the present invention is described with specificity herein to meet statutory requirements. However, the description itself is not intended to limit the scope of this disclosure. Rather, the inventors have contemplated that the claimed or disclosed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

At a high level, aspects herein are directed to a loop structure comprising a pocket space that is integrated into, for example, a trim piece or a waistband on a lower-body garment, where the loop structure is usable for stowing one or more items. As seen in the figures and as described herein, the loop structure may comprise a belt loop that is located on a waistband that is secured to an article of apparel. Often times, athletic garments, such as softball pants, may include pockets located on the front or back aspects of the lower-body garment in areas positioned adjacent to the wearer's thighs or buttocks. Items, such as lip balm or keys, stowed within pockets located in these locations may interfere with the player's attempt to, for instance, slide into a base and may cause discomfort to the wearer. For these reasons, there is a need for a pocket located on an article of apparel and constructed so that the pocket can stow and secure items in a manner that prevents the item from falling out of the pocket space during physical movement and also does not interfere with a wearer's movement or physical performance.

As will be discussed in more detail, the loop structure comprises two layers to form a pocket space between the two layers. The loop structure has a vertically oriented opening positioned on one lateral side of the loop structure. The opposite lateral side of the loop structure is closed. This results in the formation of a pocket space for insertion and storage of an item, such as a lip balm.

Positional terms as used herein to describe the loop structure and/or lower-body garment such as "front," "back," "upper," "top," "bottom," "external surface," "internal surface," "inner," "outer," "vertically oriented," and the like are with respect to the loop structure and/or lower-body garment being worn as intended and as shown and described herein by a wearer standing in an upright position. Thus, the front of the lower-body garment is configured to be positioned adjacent to a front lower torso and front legs of a wearer when the lower-body garment is worn, and the back of the lower-body garment is configured to be positioned adjacent to a back lower torso and back legs of the wearer when the lower-body garment is worn. The internal surface of the loop structure and/or lower-body garment is configured to face inwardly (i.e., toward a skin surface of a wearer) when the lower-body garment is worn, and the external surface of the loop structure and/or lower-body garment is configured to face away from a wearer's skin surface when the lower-body garment is worn. In addition, the upper part of the loop structure and/or lower-body garment is configured to be positioned closer to the head of the wearer as compared to the lower part of the loop structure and/or lower-body garment when the lower-body garment is worn. Unless indicated otherwise, all measurements provided herein are taken when the lower-body garment and/or loop structure are at standard ambient temperature and pressure (298.15 K and 100 kPa) and the lower-body garment and/or loop structure are in a resting state (e.g., an unstretched state).

Figure 1B:
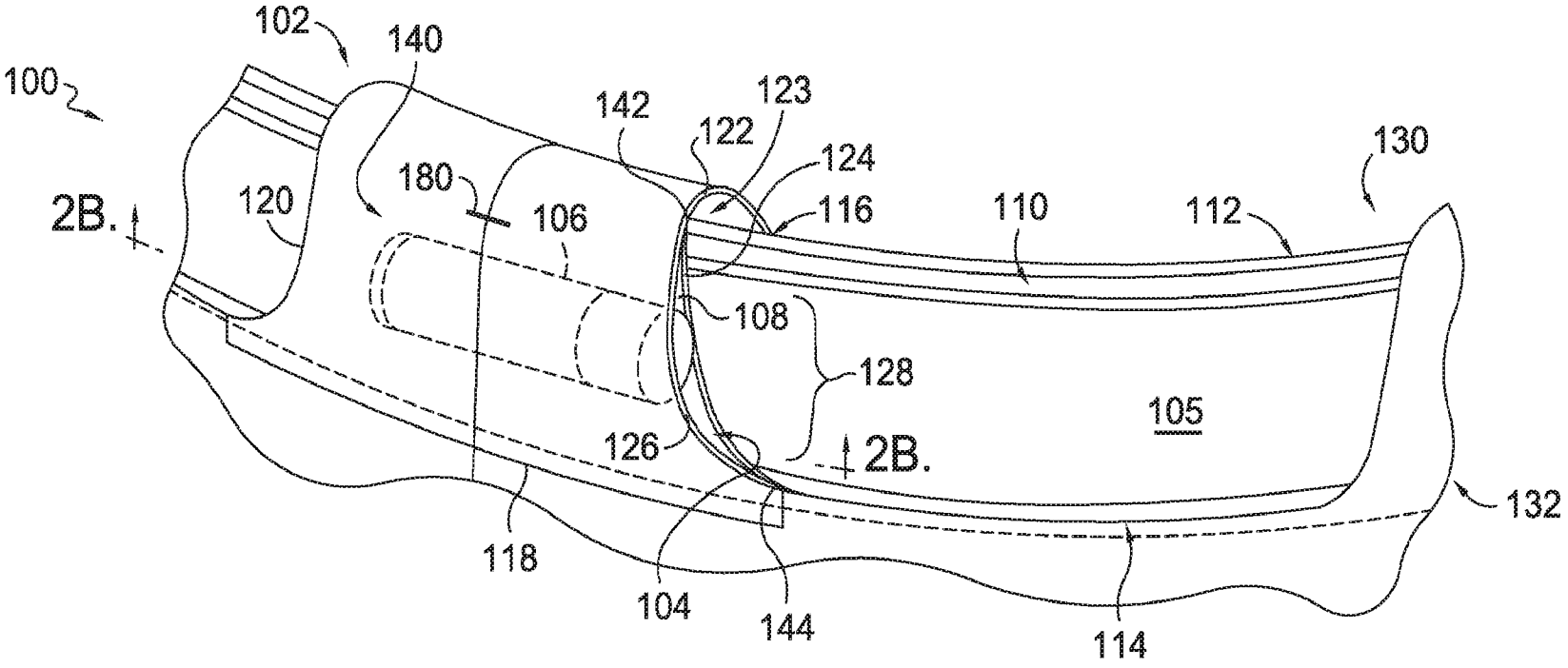
FIG. 1B illustrates the perspective view of FIG. 1A with the example item stowed within the pocket space, in accordance with aspects herein.

Turning now to FIGS. 1A and 1B, two back perspective views of a portion of an example lower-body garment 100 comprising a waistband 110 and a loop structure 102 are illustrated. In FIG. 1A, an item 106, such as a lip balm, is depicted as being inserted into a pocket space 108 of the loop structure 102 by way of a pocket opening 104. FIG. 1B depicts a second back perspective view in which the item 106 has been inserted into the pocket space 108 of the loop structure 102 and stowed. In example aspects, the waistband 110 extends from a waist opening of the lower-body garment 100. The waistband 110 has an external surface 132 and an internal surface 130 opposite the external surface 132. The waistband 110 also has a top longitudinal edge 112 and a bottom longitudinal edge 114 opposite the top edge 112.

The loop structure 102 has a top terminal end 116 and a bottom terminal end 118 opposite the top terminal end 116, a first side edge 120 extending between the top terminal end 116 and the bottom terminal end 118, and a second side edge 122 opposite the first side edge 120. The second side edge 122 also extends between the top terminal end 116 and the bottom terminal end 118. As will be explained in greater detail below, the top terminal end 116 of the loop structure 102 is secured to the waistband 110 proximate the top edge 112 of the waistband 110, and the bottom terminal end 118 of the loop structure 102 is secured to the waistband 110 proximate the bottom edge 114 of the waistband 110.

The loop structure 102 further comprises an inner layer of material 124 and an outer layer of material 126. The outer layer of material 126 is positioned adjacent and external to the inner layer of material 124 to form the pocket space 108 between the outer layer of material 126 and the inner layer of material 124. In example aspects, the outer layer of material 126 is continuously affixed to the inner layer of material 124 at the first side edge 120 of the loop structure 102 (seen in FIG. 2B at 146). In additional example aspects, the outer layer of material 126 is non-continuously affixed to the inner layer of material 124 at least at a portion of the second side edge 122 to form the pocket opening 104 to the pocket space 108. To describe this in a different way, the outer layer of material 126 is affixed to the inner layer of material 124 at a first end 142 and a second end 144 of an unaffixed portion 128 (shown in FIG. 1B) on the second side edge 122 of the loop structure 102 to form the pocket opening 104 to the pocket space 108. In example aspects, the pocket opening 104 is oriented generally perpendicular (within about ±10 degrees of a perpendicular orientation) to at least the top edge 112 of the waistband 110. To state this differently, the pocket opening 104 may be generally vertically oriented.

In some instances, the loop structure 102 may comprise a belt loop, which allows for a belt strap 105 to be inserted internal to the loop structure 102. The loop structure 102 comprises an intervening portion 140 extending between the top terminal end 116 and the bottom terminal end 118. In example aspects, the intervening portion 140 is unaffixed from the waistband 110 such that a space 123 is formed between the loop structure 102 and the waistband 110 through which the belt strap 105 can be threaded. More particularly, the space 123 is formed between the inner layer of material 124 of the loop structure 102 and the external surface 132 of the waistband 110. In example aspects, and as shown, the bottom terminal end 118 of the loop structure 102 may have a longer length than the top terminal end 116 of the loop structure 102 to provide a secure attachment of the loop structure 102 to the waistband 110 and/or the lower-body garment 100. However, it is contemplated herein, that the bottom terminal end 118 of the loop structure 102 and the top terminal end 116 of the loop structure 102 may have the same length, or the top terminal end 116 of the loop structure 102 may have a longer length than the bottom terminal end 118 of the loop structure 102. Any and all aspects, and any variation thereof, are contemplated as being within aspects herein.

In example aspects, the intervening portion 140 comprises at least one additional affixation area 180 where the inner layer of material 124 is affixed to the outer layer of material 126. The affixing may comprise stitching, tacking, bonding, welding, and the like. The affixation area 180 is shown as being positioned closer to the top edge 112 of the waistband 110 than the bottom edge 114 of the waistband 110 and is shown as being positioned approximately midway between the first side edge 120 and the second side edge 122 of the loop structure 102. The affixation area 180 is shown as extending only partially along the length of the loop structure 102, although it is contemplated herein that the affixation area 180 may extend along all or substantially all (i.e., about 80% or more) of the length of the loop structure 102. Use of the affixation area 180 effectively reduces the volume of the pocket space 108 to better help secure items, such as the item 106, in the pocket space 108 so that the item 106 remains in place through various types of movement. While FIGS. 1A and 1B illustrate a single additional affixation area 180 where the first layer of material 124 is secured to the second layer of material 126 in the intervening portion 140 of the loop structure 102, it is contemplated that more than one affixation area may be present. For example, in FIGS. 4-5, three affixation areas 206, 208, and 210 are illustrated. Any and all variations of the number of additional affixation areas are contemplated herein.

The loop structure 102 may be located at a back aspect (seen in FIG. 5) of the lower-body garment 100. However, it is contemplated that the loop structure 102 may positioned in other areas along the waistband 110 (e.g. front aspect, side aspects). Additionally, although the loop structure 102 is shown being positioned on the external surface 132 of the waistband 110, it is contemplated that the loop structure 102 may additionally or alternatively be positioned on the internal surface 130 of the waistband 110, such that the pocket space 108 and the pocket opening 104 are located on the internal surface 130 of a lower-body garment. In this configuration, a wearer would be able to stow an item, with the item stowed in the pocket space 108 on the internal surface 130, thereby not being accessible or visible on the external surface 132 of the waistband 110. Any and all aspects, and any variation thereof, are contemplated as being within the scope herein.

As mentioned, FIG. 1B illustrates the item 106 after it has been inserted into the pocket space 108 by way of the pocket opening 104. As can be seen, the item 106 is fully or entirely positioned in the pocket space 108. Although the item 106 is shown as lip balm, it is contemplated that any item with a size and shape to fit into the pocket opening 104 may be inserted into the pocket space 108.

Figure 2A:
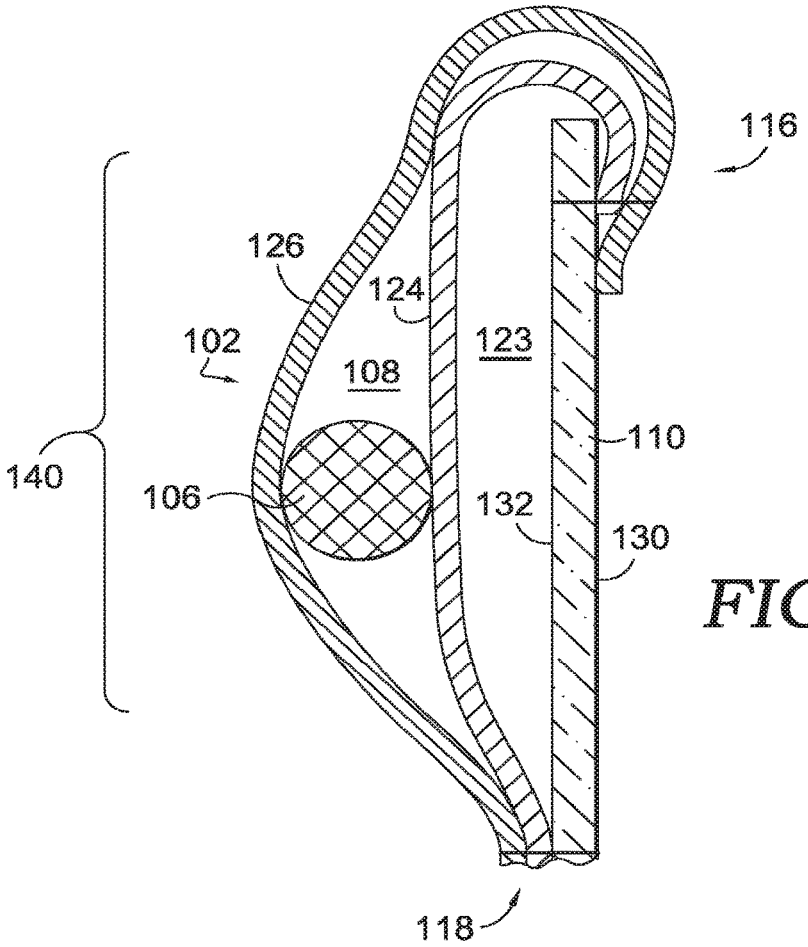
FIG. 2A illustrates a cross-section taken at cut line 2A-2A of FIG. 1A, in accordance with aspects herein.

Turning next to FIG. 2A, a cross-section taken at cut line 2A-2A of FIG. 1A is shown. In FIG. 2A, the waistband 110, as well as the inner layer of material 124 and the outer layer of material 126 of the loop structure 102 are shown. Additionally, the item 106 is shown stowed within the pocket space 108 of the loop structure 102. The pocket space 108 formed between the inner layer of material 124 and the outer layer of material 126 of the loop structure 102 has a width, length, and depth that allows the item 106 to rest in the pocket space 108 and remain secure. The intervening portion 140 of the loop structure 102 is unaffixed from the waistband 110, forming the space 123 between the inner layer of material 124 of the loop structure 102 and the external surface 132 of the waistband 110. This construction allows for the waistband 110 to remain functional for other purposes, such as for tightening and/or loosening the circumference of the waistband 110 using a belt strap, while also providing the additional function of the pocket space 108 for stowing the item 106.

FIG. 2A further illustrates how in one example aspect, the top terminal end 116 of the loop structure 102 may be affixed to the internal surface 130 of the waistband 110, and the bottom terminal end 118 of the loop structure 102 may be affixed to the external surface 132 of the waistband 110. This construction is illustrative only, and it is contemplated herein that the top terminal end 116 of the loop structure 102 may, instead, be affixed to the external surface 132 of the waistband 110. Any and all aspects, and any variation thereof, are contemplated as being within aspects herein.

Figure 2B:
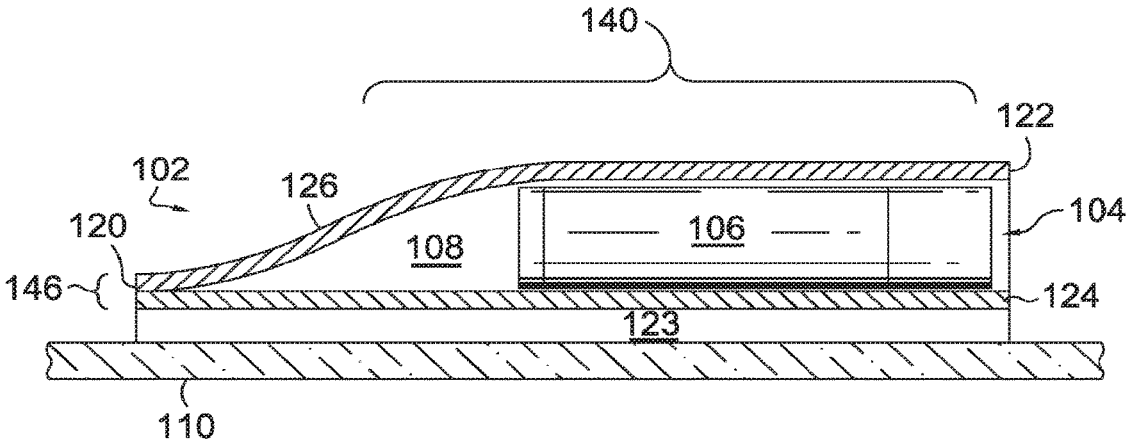
FIG. 2B illustrates a cross-section taken at cut line 2B-2B of FIG. 1B, in accordance with aspects herein.

FIG. 2B illustrates a second cross-section taken at cut line 2B-2B of FIG. 1B. As more clearly depicted in FIG. 2B, the item 106 has been inserted into the pocket space 108 by way of the pocket opening 104. FIG. 2B illustrates how the outer layer of material 126 is affixed to the inner layer of material 124 at the first side edge 120 of the loop structure 102 as indicated by reference numeral 146. In example aspects, the affixing at this location is continuous, providing an opening for the item 106 on only the second side edge 122 of the loop structure 102. As such, when a wearer wearing the lower-body garment 100 wants to utilize the pocket space 108 provided in the loop structure 102, the wearer would utilize the pocket opening 104 for inserting the item 106. Affixing the outer layer of material 126 to the inner layer of material 124 at the first side edge 120 of the loop structure 102 may provide a more secure containment space of items stowed within the pocket space 108.

It is contemplated that in other aspects, the first side edge 120 may instead have a pocket opening and the outer layer of material 126 may instead be continuously affixed to the inner layer of material 124 at the second side edge 122 of the loop structure 102, thereby creating a pocket space and pocket opening that is the opposite of what is presently shown in FIG. 2B. This aspect may be incorporated into an apparel item customized, for instance, for a left-handed wearer.

In yet another example aspect, it is contemplated herein that both the first side edge 120 and the second side edge 122 may each comprise a pocket opening formed by non-continuously affixing the inner layer of material 124 to the outer layer of material 126 to form a pocket opening to the pocket space formed between the two layers of material 124 and 126. This construction may allow for both right-handed and left-handed wearers. Any and all aspects, and any variation thereof, are contemplated as being within aspects herein.

Figure 3:
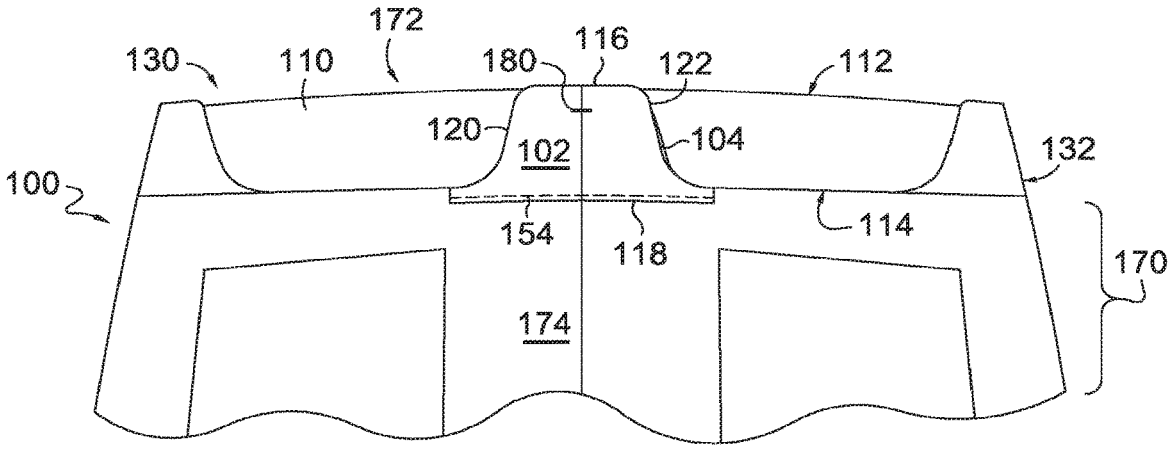
FIG. 3 illustrates a back view of a portion of the lower-body garment of FIG. 1A, in accordance with aspects herein.

Next, FIG. 3 illustrates a back view of a portion of the lower-body garment 100 of FIG. 1A comprising the loop structure 102 that has been secured to the lower-body garment 100, in accordance with aspects herein. As shown in FIG. 3, the loop structure 102 is located on a rear aspect 174 of the lower-body garment 100 although it is contemplated herein that the loop structure 102 may be located at other locations on the waistband 110. The waistband 110 is shown extending from the lower-body garment 100 at a torso portion 170 of the lower-body garment 100. More particularly, the torso portion 170 comprises a waist opening 172 defined by the waistband 110 extends. It is contemplated herein that the waistband 110 may comprise a separate construction that is affixed to the lower-body garment 100 using affixing technologies such as stitching, bonding, welding, and the like. It is also contemplated herein that the waistband 110 may be integrally formed from the lower-body garment 100 during, for example, a single knitting or weaving event. Reference numeral 154 indicates where the loop structure 102 is affixed to the waistband 110 and the lower-body garment 100 using, for instance, stitching, and the like.

Figure 4:
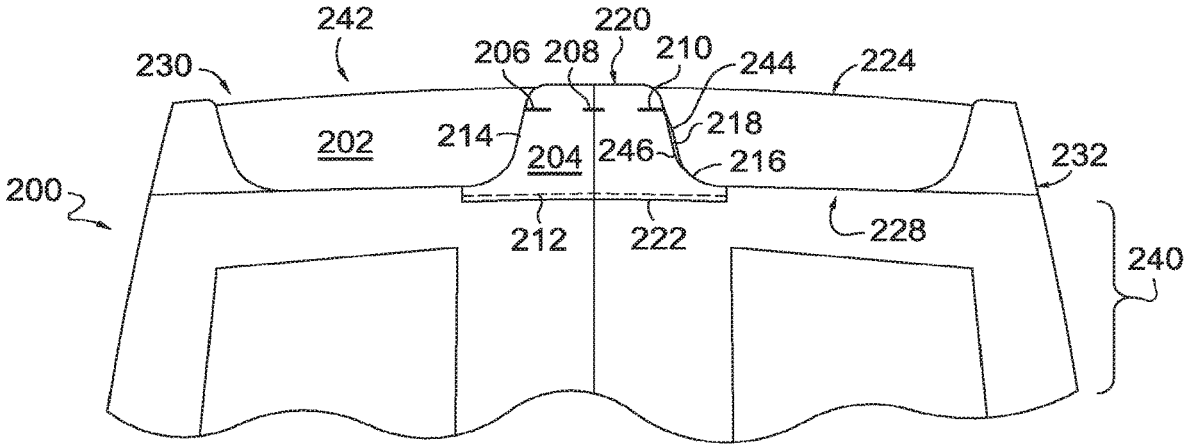
FIG. 4 illustrates a back view of a portion of another example lower-body garment comprising a waistband and a loop structure having a pocket space, in accordance with aspects herein.

In FIG. 4 a portion of another example lower-body garment 200 comprising a waistband 202 with a loop structure 204 is shown, in accordance with aspects herein. The features of the lower-body garment 200 are similar to the lower-body garment 100 of FIG. 3. For example, the lower-body garment 200 comprises the waistband 202 and the loop structure 204 where the waistband 202 extends from a torso portion 240 of the lower-body garment 200. The torso portion 240 includes a waist opening 242. The waistband 202 has an internal surface 230 and an external surface 232 opposite the internal surface 230. Further, the waistband comprises a top longitudinal edge 224 and a bottom longitudinal edge 228 opposite the top edge 224. The loop structure 204 of FIG. 4 comprises a top terminal end 220, a bottom terminal end 222 opposite the top terminal end 220, a first side edge 214 that extends between the top terminal end 220 and the bottom terminal end 222, and a second side edge 216 opposite the first side edge 214 and that extends between the top terminal end 220 and the bottom terminal end 222. The top terminal end 220 of the loop structure 204 is secured to the waistband 202 proximate the top edge 224 of the waistband 202 and the bottom terminal end 222 of the loop structure 204 is secured to the waistband 202 proximate the bottom edge 228 of the waistband 202.

The loop structure 204 has an inner layer of material 244 and an outer layer of material 246. The outer layer of material 246 is positioned adjacent and external to the inner layer of material 244 to form a pocket space (not shown). In example aspects, the outer layer of material 246 is continuously affixed to the inner layer of material 244 at the first side edge 214 of the loop structure 204. The outer layer of material 246 is non-continuously affixed to the inner layer of material 244 at least at a portion of the second side edge 216 to form a pocket opening 218 to the pocket space.

FIG. 4 is provided to illustrate additional affixation areas 206, 208, and 210 on the loop structure 204, where the additional affixation areas 206, 208, and 210 represent areas where the outer layer of material 246 of the loop structure 204 is additionally affixed to the inner layer of material 244 of the loop structure 204. The additional affixation areas 206, 208, and 210 effectively reduce the pocket volume and help to further secure the item (not shown) within the pocket space. With respect to the affixation area 210, the affixation area 210 reduces the size of the pocket opening 218. The additional affixation areas 206, 208, and 210 are located inferior to the top terminal end 220 of the loop structure 204 and extend longitudinally between the first side edge 214 and the second side edge 216 of the loop structure 204. The distance between the top terminal end 220 of the loop structure 204 and the additional affixation areas 206, 208, and 210 may vary depending on the desired volume of the pocket space. For example, if the item intended to be stowed is small, such as a lip balm, the additional affixation areas 206, 208, and 210 may be a greater distance inferior from the top terminal end 220 of the loop structure 204 than if the item to be stowed within the pocket space is larger, such as a pen. It is contemplated that fewer or more additional affixation areas may be present depending on the intended size and shape of the item to be stowed within the pocket space.

Figure 5:
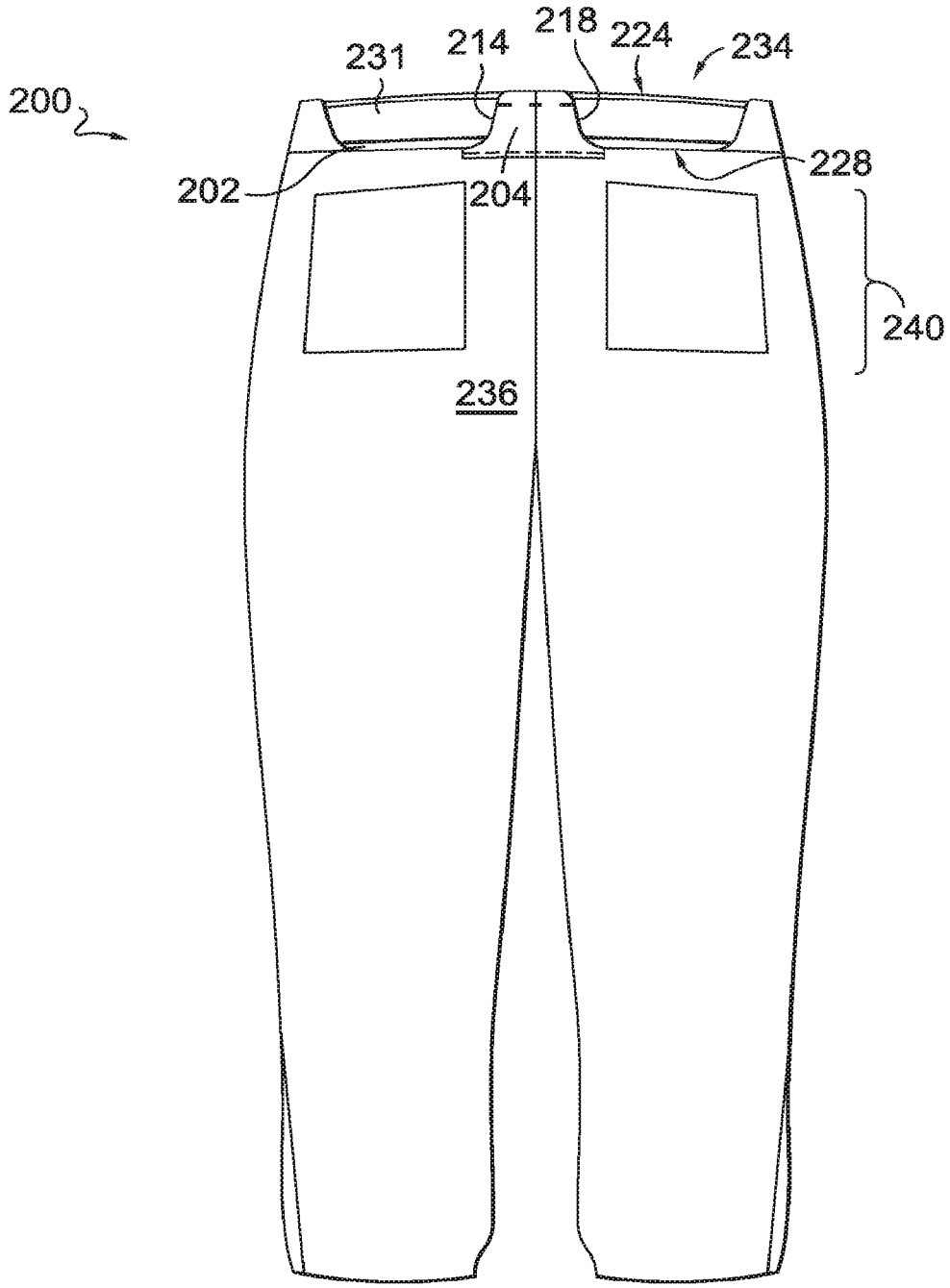
FIG. 5 illustrates a back view of a lower-body garment comprising a waistband and a loop structure having a pocket space, in accordance with aspects herein.

FIG. 5 illustrates a back view of the lower-body garment 200 of FIG. 4 where the entire lower-body garment 200 is depicted, in accordance with aspects herein. Some of the features of the waistband 202 and the loop structure 204 of FIG. 4 are shown in FIG. 5. FIG. 5 further illustrates the loop structure 204 comprising a belt loop in which a belt strap 231 has been inserted. The positioning of the loop structure 204 on a back aspect 236 of the lower-body garment 200 allows for a wearer wearing the lower-body garment 200 to reach behind their torso and insert an item into the pocket space located on the back aspect 236 to stow the desired item. Although the lower-body garment 200 is depicted as a pant, the lower-body garment 200 may comprise other constructions such as a short, a capri, a skirt, a skort, and the like.

Figure 6:
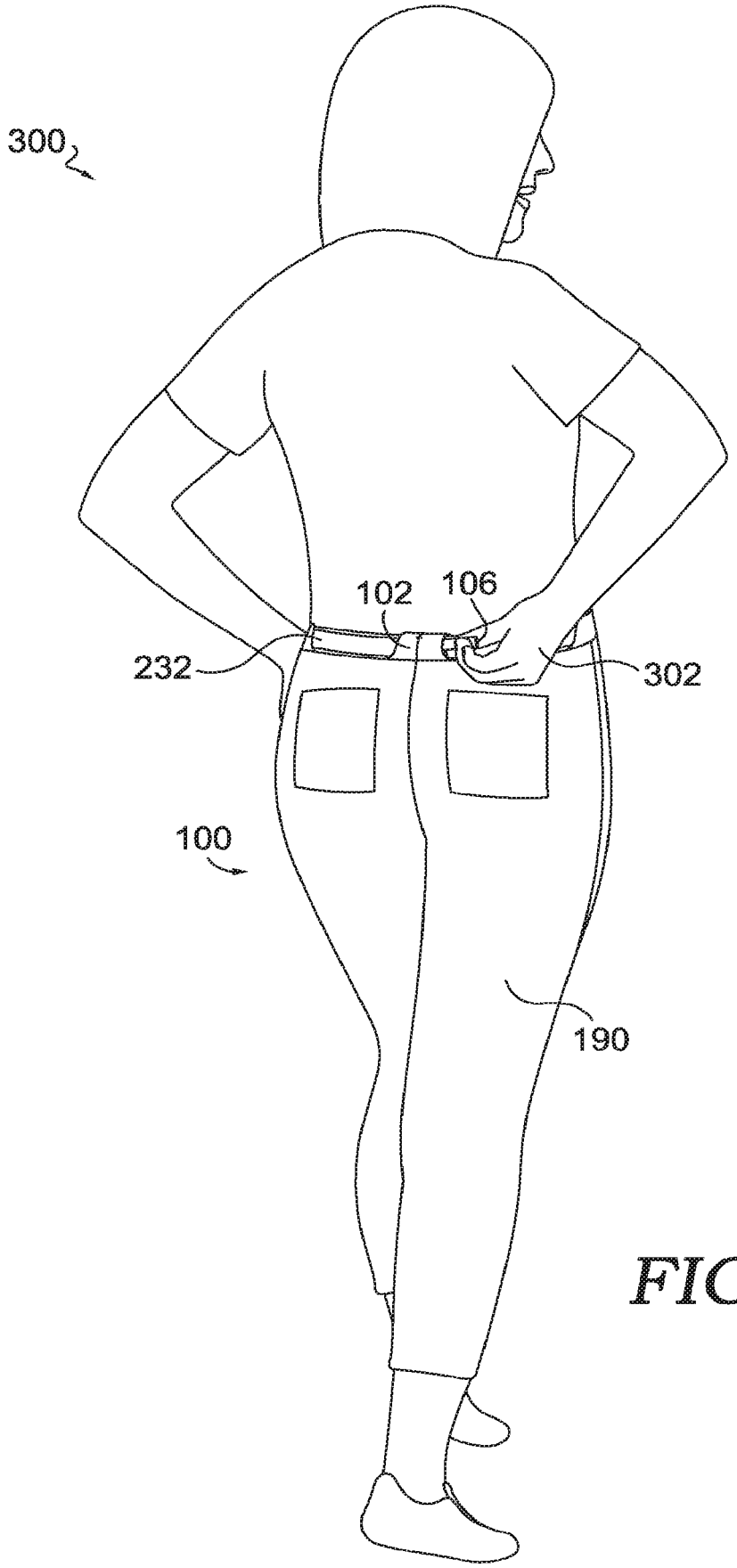
FIG. 6 illustrates a wearer inserting an example item into a pocket space of a loop structure located on a lower-body garment, in accordance with aspects herein.
Figure 7:
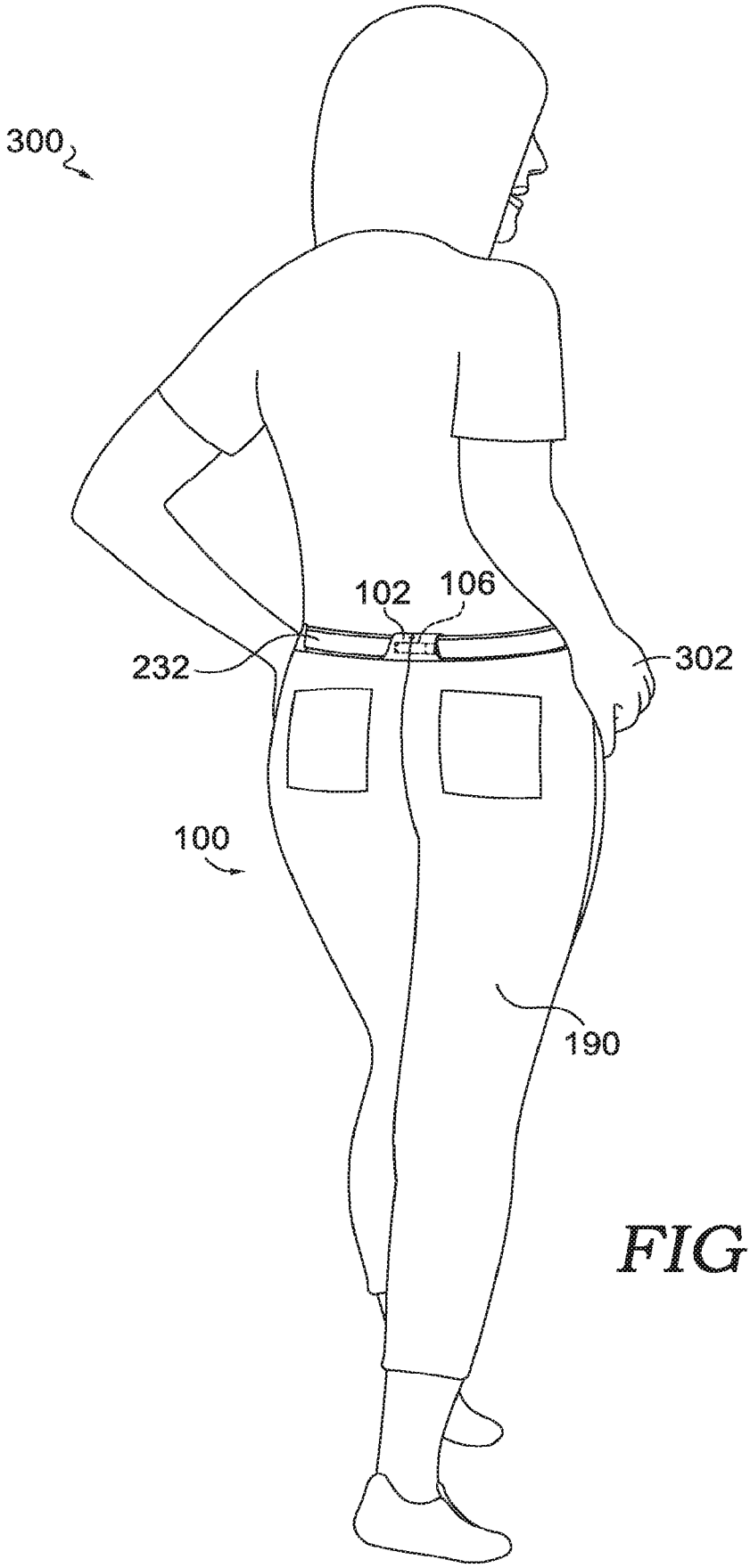
FIG. 7 illustrates the example item of FIG. 6 stowed within the pocket space of the loop structure of FIG. 6, in accordance with aspects herein.

Next, FIG. 6 illustrates a wearer 300 wearing the lower-body garment 100 of FIGS. 1A-1B, 2A-2B, and FIG. 3 and inserting the example item 106 (shown as a lip balm) into the pocket space 108 of the loop structure 102 positioned on a back aspect 190 of the lower-body garment 100. As shown, the wearer 300, using their hand 302, is inserting the item 106 into the pocket space 108. FIG. 7 illustrates the item 106 after it has been inserted into the pocket space 108. As previously described, the item 106 will be stowed and secured within the pocket space 108 so that the wearer 300 may move about or participate in physical activity, such as sliding into a base during a softball game, without the item 106 falling out of the pocket space 108 or interfering with a desired activity.

Figure 8:
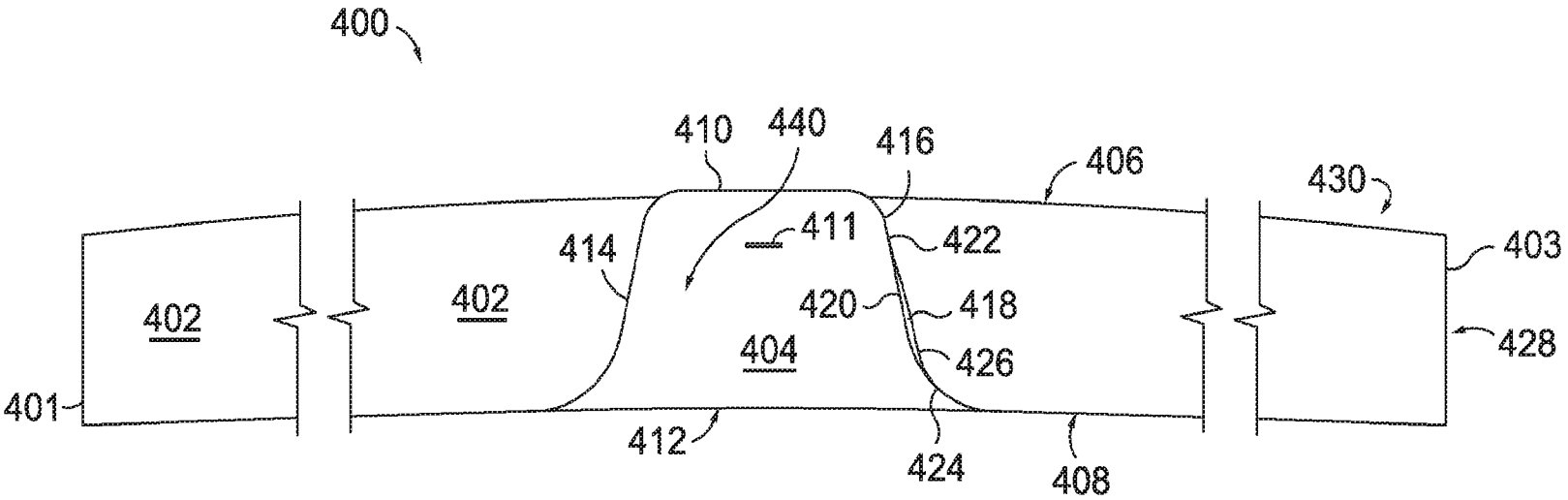
FIG. 8 illustrates an example trim piece comprising a base layer and a loop structure comprising a pocket space for stowing items, in accordance with aspects herein.

Next, FIG. 8 illustrates an example trim piece 400 comprising a base layer 402 and a loop structure 404, in accordance with aspects herein. The trim piece 400 is shown with break lines to indicate that it can be any number of lengths. The base layer 402 comprises at least a first longitudinal edge 406 and a second longitudinal edge 408 that is opposite the first longitudinal edge 406. The base layer 402 also comprises a first surface 428 and a second surface 430 opposite the first surface 428. Additionally, the base layer 402 comprises a first end 401 and a second end 403 opposite the first end 401. With respect to the loop structure 404, the loop structure 404 has a first terminal end 410 and a second terminal end 412 opposite the first terminal end 410. The first terminal end 410 of the loop structure 404 is secured to the base layer 402 proximate the first longitudinal edge 406 of the base layer 402. In example aspects, the first terminal end 410 of the loop structure 404 may be secured to the second surface 430 of the base layer 402. In example aspects, the second terminal end 412 of the loop structure 404 may be secured to the base layer 402 proximate the second longitudinal edge 408 of the base layer 402 on the first surface 428 of the base layer 402.

The loop structure 404 further comprises a first side edge 414 that extends between the first terminal end 410 and the second terminal end 412. The loop structure 404 also has a second side edge 416 that extends between the first terminal end 410 and the second terminal end 412. Like the other loop structures described herein, the loop structure 404 comprises a first layer of material 426 and a second layer of material 420. The second layer of material 420 is positioned adjacent and external to the first layer of material 426 to form a pocket space (not shown, but similar to the pocket space 108 of FIG. 1A-2B). Also, like the previous aspects described herein, the second layer of material 420 may be continuously affixed to the first layer of material 426 at the first side edge 414 of the loop structure 404. Further, the second layer of material 420 is affixed to the first layer of material 426 at both a first end 422 and a second end 424 of an unaffixed portion on the second side edge 416 of the loop structure, where the unaffixed portion forms a pocket opening 418 to the pocket space.

The loop structure 404 of the trim piece 400 also comprises an intervening portion 440 that extends between the first terminal end 410 and the second terminal end 412. Similar to constructions already described, the intervening portion 440 of the loop structure 404 is unaffixed from the base layer 402 such that a space is formed between the intervening portion 140 of the loop structure 404 and the base layer 402. Like the intervening portion 140 previously described, the intervening portion 440 of the loop structure 404 may comprise at least one additional affixation area 411 where the first layer of material 426 is affixed to the second layer of material 420.

The trim piece 400 may be incorporated into any number of articles such as, for example, an underband of a support garment of a bra, a cuff of a shirt or pant, a waistband of a shirt or jacket, a collar of a shirt or jacket, a hat, a shoe, and the like. Any and all aspects, and any variation thereof, are contemplated as being within aspects herein.

Figure 9:
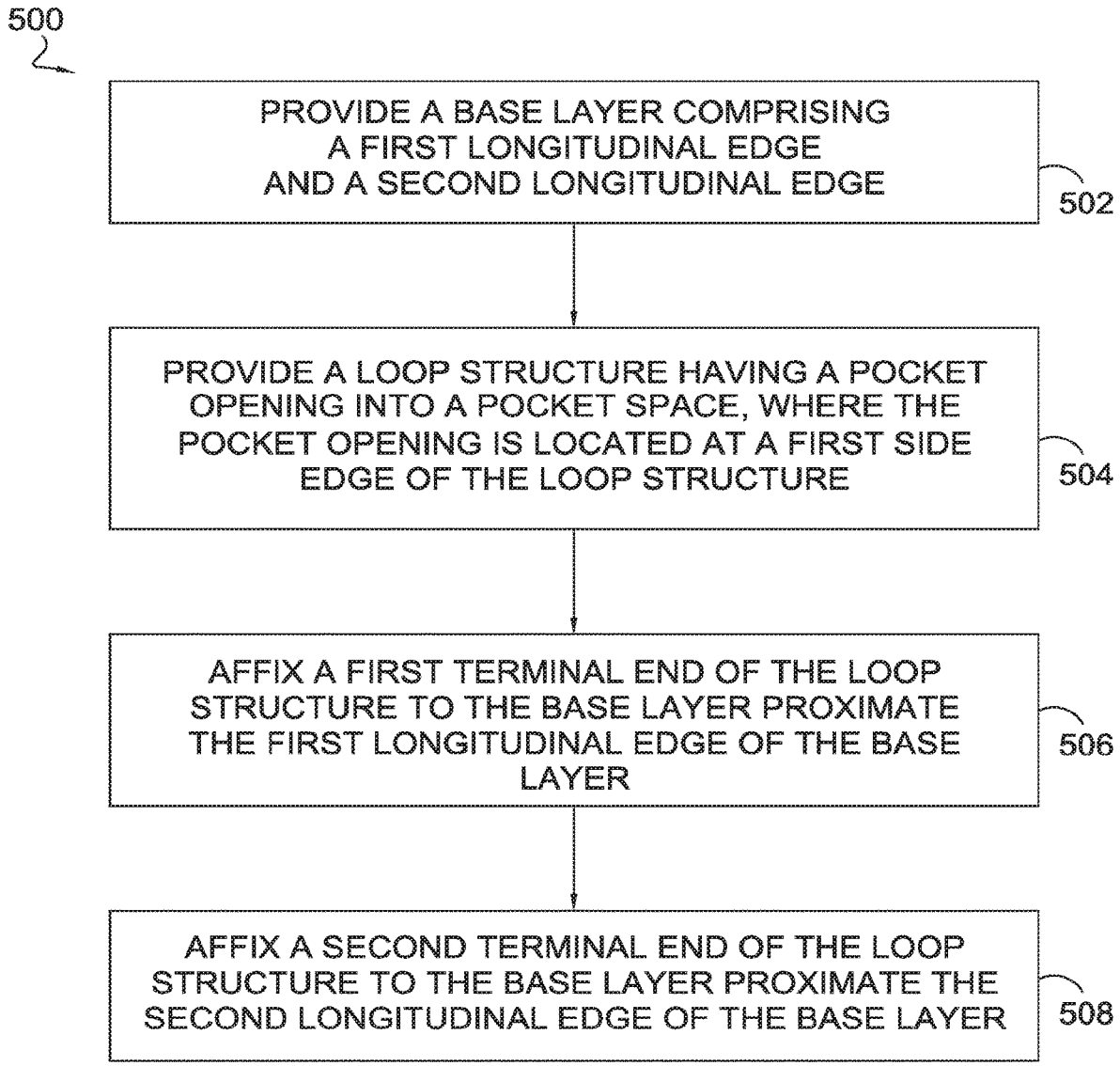
FIG. 9 is a flow diagram of an example method of manufacturing a trim piece comprising a loop structure, in accordance with aspects herein.

Next, FIG. 9 describes an example method 500 for manufacturing a trim piece, such as the trim piece of FIG. 8. Beginning with step 502, a base layer is provided that comprises at least a first longitudinal edge and a second longitudinal edge opposite the first longitudinal edge. Next, at step 504, a loop structure is provided. As discussed herein, the loop structure comprises a first terminal end, a second terminal end opposite the first terminal end, a first side edge extending between the first terminal end and the second terminal end, and a second side edge opposite the first side edge, the second side edge also extending between the first terminal end and the second terminal end, a first layer of material, and a second layer of material positioned adjacent and external to the first layer of material to form a pocket space, where the second layer of material is continuously affixed to the first layer of material at the first side edge of the loop structure, and where the second layer of material is affixed to the first layer of material at both a first end and a second end of an unaffixed portion on the second side edge of the loop structure to form a pocket opening to the pocket space. Then, at step 506, the first terminal end of the loop structure is affixed to the base layer proximate the first longitudinal edge of the base layer. Additionally, the second terminal end of the loop structure is affixed to the base layer proximate the second longitudinal edge of the base layer at step 508. The order of the steps of the method 500 is illustrative only and may be rearranged based on manufacturing needs and efficiency. Additional method steps may comprise affixing the first layer of material of the loop structure to the second layer of material of the loop structure in at least one additional area. In example aspects, the one additional area may be positioned closer to the first longitudinal edge of the base layer than the second longitudinal edge of the base layer.

The following clauses represent example aspects of concepts contemplated herein. Any one of the following clauses may be combined in a multiple dependent manner to depend from one or more other clauses. Further, any combination of dependent clauses (clauses that explicitly depend from a previous clause) may be combined while staying within the scope of aspects contemplated herein. The following clauses are examples and are not limiting.

Clause 1. A trim piece comprising:

a base layer comprising at least a first longitudinal edge and a second longitudinal edge opposite the first longitudinal edge; and a loop structure comprising:

a first terminal end, a second terminal end opposite the first terminal end, a first side edge extending between the first terminal end and the second terminal end, a second side edge opposite the first side edge, the second side edge extending between the first terminal end and the second terminal end, wherein the first terminal end of the loop structure is secured to the base layer proximate the first longitudinal edge of the base layer, and the second terminal end of the loop structure is secured to the base layer proximate the second longitudinal edge of the base layer, a first layer of material, and a second layer of material positioned adjacent and external to the first layer of material to form a pocket space, wherein the second layer of material is continuously affixed to the first layer of material at the first side edge of the loop structure, and wherein the second layer of material is affixed to the first layer of material at both a first end and a second end of an unaffixed portion on the second side edge of the loop structure to form a pocket opening to the pocket space.

Clause 2. The trim piece according to clause 1, wherein the trim piece comprises a waistband assembly.

Clause 3. The trim piece according to any of clauses 1 through 2, wherein the base layer further comprises a first surface and a second surface opposite the first surface.

Clause 4. The trim piece according to clause 3, wherein the first terminal end of the loop structure is secured to the base layer proximate the first longitudinal edge on the second surface of the base layer.

Clause 5. The trim piece according to any of clauses 3 through 4, wherein the second terminal end of the loop structure is secured to the base layer proximate the second longitudinal edge of the base layer on the first surface of the base layer.

Clause 6. The trim piece according to any of clauses 1 through 5, wherein the loop structure comprises an intervening portion extending between the first terminal end and the second terminal end.

Clause 7. The trim piece according to clause 6, wherein the intervening portion of the loop structure is unaffixed from the base layer such that a space is formed between the intervening portion of the loop structure and the base layer.

Clause 8. The trim piece according to any of clauses 6 through 7, wherein the intervening portion of the loop structure is positioned adjacent to the first surface of the base layer.

Clause 9. The trim piece according to any of clauses 6 through 8, wherein the intervening portion of the loop structure comprises at least one additional area where the first layer of material is affixed to the second layer of material.

Clause 10. The trim piece according to any of clauses 1 through 9, wherein the loop structure comprises a belt loop.

Clause 11. A lower-body garment comprising:

a torso portion having a waist opening;

a waistband extending from the waist opening of the torso portion, the waistband having an external surface, an internal surface opposite the external surface, a top edge, and a bottom edge opposite the top edge; and a loop structure comprising:

a top terminal end, a bottom terminal end opposite the top terminal end, a first side edge extending between the top terminal end and the bottom terminal end, a second side edge opposite the first side edge, the second side edge extending between the top terminal end and the bottom terminal end, wherein the top terminal end of the loop structure is secured to the waistband proximate the top edge of the waistband, and the bottom terminal end of the loop structure is secured to the waistband proximate the bottom edge of the waistband, an inner layer of material, and an outer layer of material positioned adjacent and external to the inner layer of material to form a pocket space, wherein the outer layer of material is continuously affixed to the inner layer of material at the first side edge of the loop structure, and wherein the outer layer of material is non-continuously affixed to the inner layer of material at least at a portion of the second side edge to form a pocket opening to the pocket space.

Clause 12. The lower-body garment according to clause 11, wherein the loop structure comprises a belt loop.

Clause 13. The lower-body garment according to any of clauses 11 through 12, wherein the loop structure comprises an intervening portion extending between the top terminal end and the bottom terminal end, and wherein the intervening portion of the loop structure is unaffixed from the waistband such that a space is formed between the loop structure and the waistband.

Clause 14. The lower-body garment according to clause 13, wherein the intervening portion of the loop structure comprises at least one additional area where the inner layer of material is affixed to the outer layer of material.

Clause 15. The lower-body garment according to any of clauses 11 through 14, wherein the loop structure is positioned at a back aspect of the lower-body garment.

Clause 16. The lower-body garment according to any of clauses 11 through 15, wherein the bottom terminal end of the loop structure has a longer length than the top terminal end of the loop structure.

Clause 17. The lower-body garment according to any of clauses 11 through 16, wherein the pocket opening is oriented generally perpendicular to at least the top edge of the waistband.

Clause 18. The lower-body garment according to any of clauses 11 through 17, wherein the outer layer of material is affixed to the inner layer of material at both a first end and a second end of an unaffixed portion on the second side edge of the loop structure to form the pocket opening to the pocket space.

Clause 19. A method of manufacturing a trim piece, the method comprising:

providing a base layer comprising at least a first longitudinal edge and a second longitudinal edge opposite the first longitudinal edge;

providing a loop structure comprising a first terminal end, a second terminal end opposite the first terminal end, a first side edge extending between the first terminal end and the second terminal end, and a second side edge opposite the first side edge, the second side edge also extending between the first terminal end and the second terminal end, a first layer of material, and a second layer of material positioned adjacent and external to the first layer of material to form a pocket space, wherein the second layer of material is continuously affixed to the first layer of material at the first side edge of the loop structure, and wherein the second layer of material is affixed to the first layer of material at both a first end and a second end of an unaffixed portion on the second side edge of the loop structure to form a pocket opening to the pocket space;

affixing the first terminal end of the loop structure to the base layer proximate the first longitudinal edge of the base layer; and affixing the second terminal end of the loop structure to the base layer proximate the second longitudinal edge of the base layer.

Clause 20. The method of manufacturing according to clause 19, wherein the first layer of material of the loop structure is affixed to the second layer of material of the loop structure in at least one additional area.

Clause 21. The method of manufacturing according to clause 20, wherein the at least one additional area is positioned closer to the first longitudinal edge of the base layer than the second longitudinal edge of the base layer.

Aspects of the present disclosure have been described with the intent to be illustrative rather than restrictive. Alternative aspects will become apparent to those skilled in the art that do not depart from its scope. A skilled artisan may develop alternative means of implementing the aforementioned improvements without departing from the scope of the present disclosure.

It will be understood that certain features and subcombinations are of utility and may be employed without reference to other features and subcombinations and are contemplated within the scope of the claims. Not all steps listed in the various figures need be carried out in the specific order described.

What is claimed is:

1. A lower-body garment comprising:

a torso portion having a waist opening;

a waistband comprising a first material layer coupled to the torso portion, the first material layer having an external surface, an internal surface opposite the external surface, a top edge forming an upper terminal edge of the lower-body garment, and a bottom edge opposite the top edge; and a multilayer belt loop structure affixed to the first material layer of the waistband and comprising:

an inner material layer;

an outer material layer affixed to the inner material layer and spaced apart from the inner material layer to form a pocket between the inner material layer and the outer material layer;

a top terminal end at which the inner material layer and the outer material layer are affixed to the first material layer;

a bottom terminal end at which the inner material layer and the outer material layer are affixed to the first material layer;

an intervening portion that is between the top terminal and the bottom terminal end and that is unaffixed from the first material layer, such that a through space is formed between the multilayer belt loop and the first material layer, the through space being configured to slidably receive a belt;

a first side edge extending between the top terminal end and the bottom terminal end and along which the inner material layer and the outer material layer are affixed to close a portion of the pocket; and a second side edge that is opposite the first side edge and that extends between the top terminal end and the bottom terminal end, wherein the inner material layer and the outer material layer are non-continuously attached along the second side edge to form a pocket opening to the pocket, and wherein, along the first side edge and the second side edge, both the inner material layer and the outer material layer angle outward as they extend from the top terminal end to the bottom terminal end to form a bottom portion of the pocket that is larger than a top portion of the pocket and that is configured to retain items stowed in the pocket.

2. The lower-body garment of claim 1, wherein the multilayer belt loop structure is positioned at a back aspect of the lower-body garment.

3. The lower-body garment of claim 1, wherein the bottom terminal end of the multilayer belt loop structure comprises a bottom terminal edge, and wherein the top terminal end of the multilayer belt loop structure comprises a top terminal edge, which is shorter than the bottom terminal edge.

4. The lower-body garment of claim 1, wherein the outer layer of material is affixed to the inner layer of material at both a first end and a second end of an unaffixed portion on the second side edge of the loop structure to form the pocket opening to the pocket space.

5. The lower-body garment of claim 1, wherein the multilayer belt loop wraps over the top edge of the first material layer, and wherein the top terminal end is affixed directly to the internal surface of the first material layer.

6. The lower-body garment of claim 1 further comprising, a discrete affixation point attaching the inner material layer to the outer material layer, wherein the discrete affixation point is positioned between the top terminal end and the bottom terminal end of the multilayer belt loop structure and is positioned midway between the first side edge and the second side edge, and wherein the discrete affixation point is configured to reduce a volume of the pocket and to help retain an object stowed in the pocket.

7. The lower-body garment of claim 6, wherein the discrete affixation point comprises stitching, tacking, bonding, or welding.

8. A lower-body garment comprising:

a torso portion having a waist opening;

a waistband comprising a first material layer and forming the waist opening, the first material layer comprising an external surface, an internal surface opposite the external surface, and a top terminal edge; and a multilayer belt loop structure affixed to the first material layer of the waistband and comprising:

an inner material layer;

an outer material layer affixed to the inner material layer and spaced apart from the inner material layer to form a pocket between the inner material layer and the outer material layer;

a top terminal end at which the inner material layer and the outer material layer are affixed to the first material layer, a bottom terminal end at which the inner material layer and the outer material layer are affixed to the first material layer, an intervening portion that is between the top terminal and the bottom terminal end and that is unaffixed from the first material layer, such that a through space is formed between the multilayer belt loop and the first material layer, the through space being configured to slidably receive a belt;

a first side edge extending between the top terminal end and the bottom terminal end and along which the inner material layer and the outer material layer are affixed to close a portion of the pocket;

a second side edge that is opposite the first side edge and that extends between the top terminal end and the bottom terminal end, wherein the inner material layer and the outer material layer are non-continuously attached along the second side edge to form a pocket opening to the pocket and wherein, along the first side edge and the second side edge, both the inner material layer and the outer material layer angle outward as they extend from the top terminal end to the bottom terminal end to form a bottom portion of the pocket that is wider than a top portion of the pocket and that is configured to retain items stowed in the pocket; and a discrete affixation point attaching the inner material layer to the outer material layer, wherein the discrete affixation point is positioned between the top terminal end and the bottom terminal end of the multilayer belt loop structure and midway between the first side edge and the second side edge, wherein the discrete affixation point comprises a length that spans only part way between the first side edge and the second side edge, and wherein the discrete affixation point is configured to reduce a volume of the pocket and to help retain an object stowed in the pocket.

9. The lower-body garment of claim 8, wherein the discrete affixation point comprises stitching, tacking, bonding, or welding.

10. The lower-body garment of claim 8, wherein the multilayer belt loop wraps over the top terminal edge and the top terminal end of the multilayer belt loop is affixed directly to the internal surface of the first material layer.

11. The lower-body garment of claim 8 further comprising, a belt extending through the through space and between the inner material layer and the first material layer.

* * * * *